US006247578B1

(12) United States Patent
Steinhauser et al.

(10) Patent No.: US 6,247,578 B1
(45) Date of Patent: Jun. 19, 2001

(54) DEVICE FOR THE AUTOMATIC CONVEYANCE OF WORKPIECES ON A MULTISTAGE METAL-FORMING MACHINE TOOL

(75) Inventors: Ulrich Steinhauser, Allschwil (CH); Stefan Stöckle, Freiburg (DE); Christoph Pergher, Muttenz (CH)

(73) Assignee: Hatebur Unformmaschinen AG, Reinach (CH)

( * ) Notice: Subject to any disclaimer, the term of this patent is extended or adjusted under 35 U.S.C. 154(b) by 0 days.

(21) Appl. No.: 09/214,979

(22) PCT Filed: Sep. 29, 1997

(86) PCT No.: PCT/CH97/00366

§ 371 Date: Jan. 15, 1999

§ 102(e) Date: Jan. 15, 1999

(87) PCT Pub. No.: WO98/14289

PCT Pub. Date: Apr. 9, 1998

(30) Foreign Application Priority Data

Oct. 3, 1996 (CH) ..... 2410/96

(51) Int. Cl.[7] ..... B65G 25/00

(52) U.S. Cl. ..... 198/468.2; 414/753.1; 72/405.09

(58) Field of Search ..... 414/749.1, 753.1; 198/468.2; 72/361, 405.01, 405.09

(56) References Cited

U.S. PATENT DOCUMENTS 4,966,028 10/1990 Sakamura et al. .

5,865,057 * 2/1999 Nakano et al. ..... 72/361

FOREIGN PATENT DOCUMENTS 2929800 2/1981 (DE) .
0206186 12/1986 (EP) .
0726111 8/1996 (EP) .

* cited by examiner

*Primary Examiner*—Donald W. Underwood
(74) *Attorney, Agent, or Firm*—Selitto, Behr & Kim

(57) ABSTRACT

In an apparatus for automatically transporting workpieces in a multi-stage forming machine, a tong casing (1) is fitted on a transverse transporting tube (2). The tong casing (1) comprises a tong-casing basic body (10) on which there are arranged exchangeable tong modules (12*a,* 12*b,* 12*c*) each with one set of tongs by means of which a workpiece (W2, W3) can be seized laterally from above. Each set of tongs is connected, via a coupling location (19), to associated transmission means which, are in operative connection with a control shaft (3), mounted rotatably in the transverse transporting tube (2), for controlling the opening and closing movements of the tongs. The operation of transporting, from one forming station (U1, U2, U3) to the adjacent forming station (U2, U3, U4), a workpiece (W2, W3) seized by tongs with pairs of interacting tong grippers (130, 140) and the operation of moving the tongs back take place by the transverse transporting tube (2) moving back and forth. The tong displacement can be adapted to the workpieces (W2, W3) by using tong modules (12*a,* 12*b,* 12*c*) with tongs with suitable leverages.

22 Claims, 10 Drawing Sheets

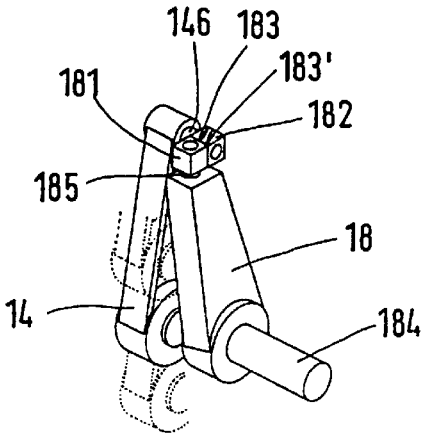
FIG. 7
FIG.8
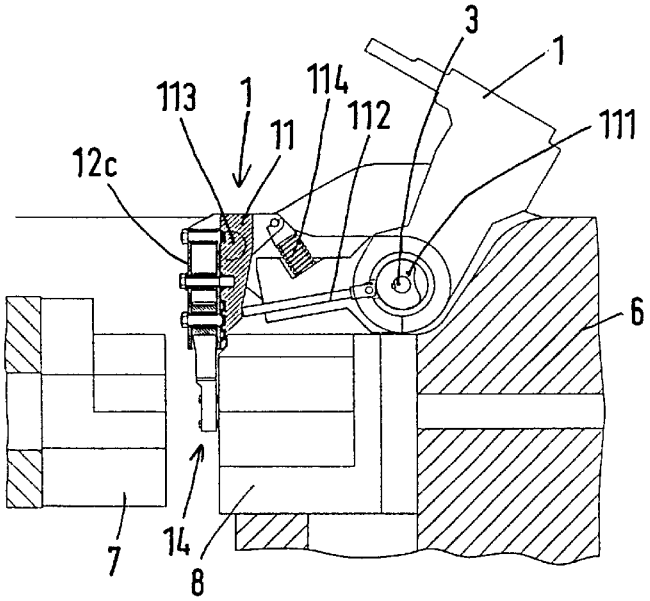
FIG.9
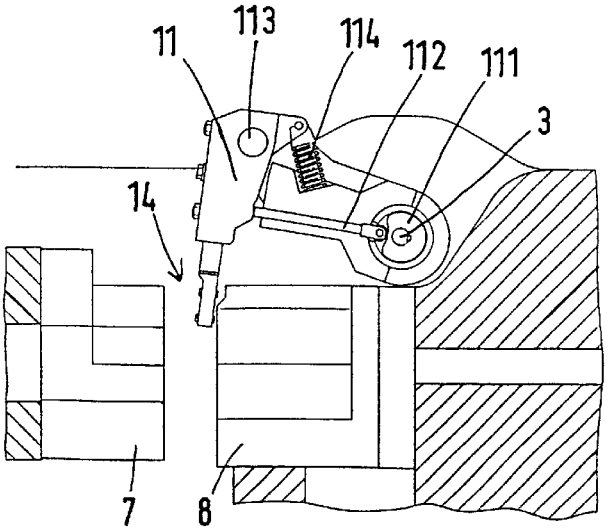

DEVICE FOR THE AUTOMATIC CONVEYANCE OF WORKPIECES ON A MULTISTAGE METAL-FORMING MACHINE TOOL

FIELD OF THE INVENTION

The present invention relates to an apparatus for automatically transporting workpieces in a multi-stage forming machine which serves for the non-cutting forming of metal parts.

BACKGROUND OF THE INVENTION

An apparatus of this type known from EP-B-0 206 186 has a top transverse transporting tube and a bottom transverse transporting tube which are driven in time with the forming machine, are guided, in the forming region of the machine, in stationary bearings so as to be able to move back and forth, and on which there are respectively fitted a top tong casing and a bottom tong casing. In order to form a unit which can be displaced with sliding action, the two transverse transporting tubes are connected by a yoke. Workpieces are seized by means of pairs of interacting tong grippers, one being arranged in the top tong casing, and the other being arranged in the bottom tong casing, and the opening and closing movements of the tongs, formed by the respectively interacting tong grippers, being controlled, via transmission levers, by control shafts, arranged rotatably in the transverse transporting tubes, in the form of camshafts. The operation, necessary in hot-forming machines, of seizing workpieces of very different sizes is easily made possible by tongs of this type.

A disadvantage of this apparatus is that, in order to seize a workpiece, a tong gripper has to be advanced up to the workpiece from beneath, as a result of which there is considerable danger of the tong gripper colliding with falling parts. Moreover, in particular in hot-forming machines, the tong grippers are exposed to pronounced soiling, for example by lubricants and/or scale and/or water. In addition, two camshafts are necessary for controlling the opening and closing movements of the tongs and two transverse transporting tubes are necessary for moving the tongs back and forth, and this means that the movements of the two camshafts and of the two transverse transporting tubes have to be coordinated in each case.

OBJECTS OF THE INVENTION

In view of the disadvantages of the previously known apparatus described above, the object of the invention is to provide an apparatus of the type mentioned in the introduction which automatically transports workpieces in a multi-stage forming machine which manages without a tong gripper which is to be advanced, from beneath, up to a workpiece which is to be seized, the intention being to ensure, in a simple and cost-effective manner, that workpieces of very different diameters or stepped workpieces, such as flanged shafts or similar parts with different diameters, can be seized at freely selectable locations. In addition, the construction of the apparatus is to be as straightforward as possible.

SUMMARY OF THE INVENTION

The essence of the invention resides in the fact that, in an apparatus for automatically transporting workpieces in a multi-stage forming machine which serves for the non-cutting forming of metal parts, a tong casing which is fitted on a transverse transporting tube comprises a tong-casing basic body on which there are arranged one or more exchangeable tong modules each with one set of tongs by means of which a workpiece can be seized laterally from above. Each set of tongs is connected, via a coupling location, to its associated transmission means, which are arranged in the tong-casing basic body, have a tong cam for controlling the opening and closing movements of the tongs and, for their part, are in operative connection with a control shaft which is mounted rotatably in the transverse transporting tube. The operation of transporting, from one forming station to the adjacent forming station, a workpiece seized by tongs with pairs of interacting tong grippers and the operation of moving the tongs back take place by the transverse transporting tube moving back and forth, so that the tube is being driven in time with the forming machine and being guided, in the forming region of the machine, in stationary bearings. The tong displacement and/or the temporal behaviour of the tong movements can be adapted to the workpieces by using tong modules with tongs with suitable leverages and/or by adjusting or exchanging the tong cams.

By using tongs which seize the workpieces laterally from above, it is possible largely to prevent excessive soiling of the two respectively interacting tong grippers. It is also ensured that, for example in the case of workpieces becoming larger as a result of wear of the dies, these workpieces are always seized centrally in the respectively interacting tong grippers. In addition, the apparatus according to the invention is of a straightforward construction since the tongs are arranged on a single tong casing fitted on a transverse transporting tube and the opening and closing movements of the tongs are controlled by a single control shaft.

Although tongs which seize workpieces laterally from above have been used for some time now in cold-forming machines, the known apparatuses and tongs do not allow workpieces of very different and comparatively large diameters to be seized. Such tongs are generally designed only for small tong-displacement differences and thus only for workpieces within a restricted diameter range.

In the apparatus according to the invention, the tong displacement can be adapted optimally to the various workpieces by using tong modules with tongs with suitable leverages and/or by adjusting or exchanging the tong cams for controlling the tongs, with the result that there is no need for, inter alia, any unnecessarily large tong movements to be executed. By selecting tongs with suitable leverages, it is possible for relatively large workpieces to be seized without the tongs of adjacent tong modules getting in the way. On the other hand, it is also possible for workpieces with large flanges to be seized at locations of small diameter, in which case the tongs execute a large displacement on account of the space requirement of the flange.

It is easy to exchange tong modules in the case of the apparatus according to the invention in that each set of tongs is connected via only one coupling location to its associated transmission means, which are arranged in the tong-casing basic body and produce the connection to the control shaft for controlling the opening and closing movements.

Since the transmission means assigned to one set of tongs has a tong cam in each case, the sequence of opening and closing movements for each set of tongs can be adjusted individually. In addition, adjustment is user-friendly since for this purpose, unlike in the apparatuses known hitherto, there is no need for the control shaft to be removed from the transverse transporting tube.

In a preferred variant, the transmission means assigned to one set of tongs comprise a tong drive shaft which is arranged at right angles to the control shaft. The tong drive shaft is in operative connection with the control shaft via a bevel gear mechanism. On the tong drive shaft arranged the tong cam by means of which, via at least one further lever of which one end is in operative connection with the tongs or a tong arm via the coupling location, the opening and closing movements of the tongs are controlled.

This variant has the advantage that the tong drive shaft, which controls the opening and closing movements of a set of tongs by means of a tong cam, rotates in the direction of the opening and closing movements, i.e. that there is no need for any movement deflection. Consequently, the mass following the tong cam can be kept lower than in the case of the apparatuses known hitherto, thus permitting quicker and more precise movement. In addition, the vibrational behaviour is improved. The movement deflection taking place between the control shaft and the tong drive shaft via a bevel gear mechanism does not have any adverse effect on the vibrational behaviour if the rotational speed of the control shaft is constant during normal operation.

In order to make it possible for the empty tongs to be moved back immediately, once the workpieces have been released in the respective target forming stations, the transverse transporting tube, on which the tong casing is fitted, is arranged rotatably, such that by rotating the transverse transporting tube by means of a transverse-transporting-tube-rotating device arranged outside the forming region, the tong casing can be raised and lowered.

In order to prevent the tongs from striking against the dies or the die holder of the forming machine when the tong casing is being raised, and in order to allow for short dies, the tong modules are preferably arranged in a module carrier which is connected to the tong-casing basic body via a module-carrier pivot spindle, and, when the tong casing is being raised, is controlled such that it is pivoted in the opposite direction together with the tong modules.

In order to control the pivoting of the module carrier with respect to the tong-casing basic body, at least one pivoting cam is advantageously provided on the control shaft and, a push rod or lever is arranged between the pivoting cam and module carrier. This means that the pivoting of the module carrier is co-ordinated in a simple manner with the tong movement.

In the apparatus according to the invention, the locations at which the tongs are coupled to the respectively associated transmission means arranged in the tong-casing basic body are advantageously arranged in the region of the module-carrier pivot spindle. As a result, pivoting of the module carrier does not automatically bring about a tong opening or closing movement as well.

In a preferred variant of an apparatus according to the invention in a forming machine which has an anvil in the die space, it is the case that, in its lowered position, the tong casing is supported on the anvil, and the support takes place via a rolling-action or sliding-action guide means, which ensures precise positioning in the vertical direction of the tongs in the forming stations. In this manner, the vertical positioning accuracy of the tongs is separate from the movement mechanism.

BRIEF DESCRIPTION OF THE DRAWING

The inventive apparatus for automatically transporting workpieces in a multi-stage forming machine is described in more detail hereinbelow with reference to the attached drawings and an exemplary embodiment. It should be kept in mind that, in order better to illustrate the various design features, different parts have been left out of the drawings in each case. The drawings are partly sectional illustrations, in which:

FIG. 7 shows a perspective view of a coupling between a tong arm and tong drive lever;

FIGS. 8, 9 show cross-sections through part of the apparatus of FIG. 1 in the forming region of the forming machine in order to illustrate the pivoting of the module carrier;

DETAILED DESCRIPTION OF THE DRAWINGS

FIG. 1

Figure 1:
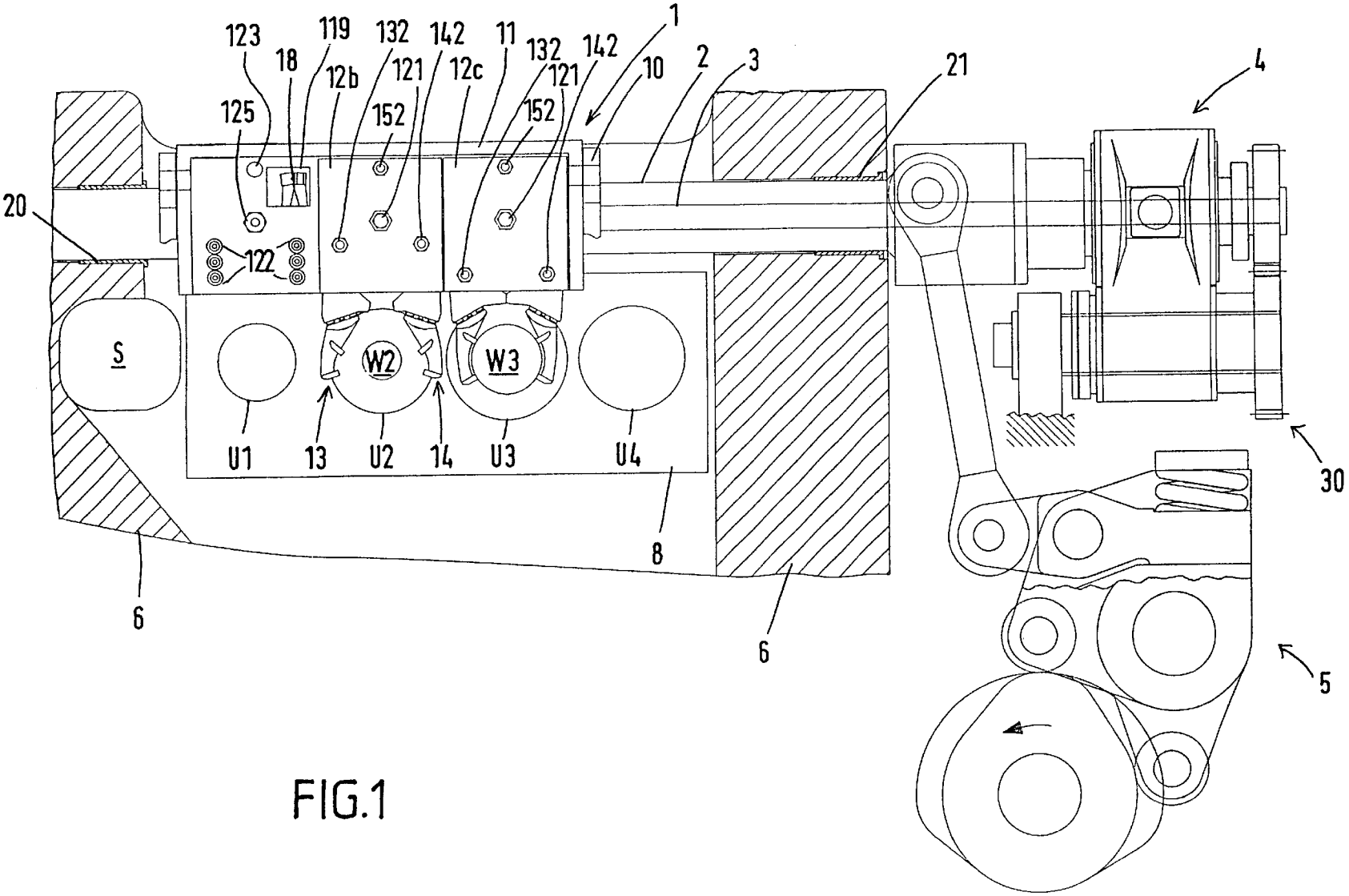
FIG. 1 shows a schematic view of a transporting apparatus according to the invention in a four-stage forming machine.

An inventive apparatus for automatically transporting workpieces is arranged on a four-stage forming machine which serves for the non-cutting forming of metal parts and has a machine body 6, a shearing station S and an anvil 8 with four forming stations U1, U2, U3, U4.

The transporting apparatus is provided with a transverse transporting tube 2 which is mounted rotatably, and so as to be able to move back and forth in the transporting direction, in transverse-transporting-tube bearings 20, 21, fitted in the machine body 6, and in which a control shaft 3 is arranged coaxially.

In the forming region of the forming machine, a tong casing 1 with a tong-casing basic body 10, a module carrier 11 and three tong modules 12*a,* 12*b,* 12*c* is fitted on the transverse transporting tube 2, the tong module 12*a* not being depicted here, with the result that it is possible to see that part of the module carrier 11 with fastening thread 125 which is located behind the same. The tong modules 12*a,* 12*b,* 12*c* each have a set of tongs with tong arms 13, 14 and are fastened on the module carrier 11 by means of central module fastening screws 121. In the square opening 119 in the module carrier 11, it is possible to see one end of a tong drive lever 18 in the left-hand end position and right-hand end position. Supporting bolts 152 on the tong modules, e.g. screws, of which one end surface rests in each case on a bearing element 123 of the module carrier 11, serve for stabilizing the tong modules 12*a*, 12*b*, 12*c* on the module carrier 11. Pivot articulations 132, 142 of the tongs are arranged, depending on the desired tong displacement, on bearing elements 122 on the module carrier 11. The module-carrier-side ends of the pivot articulations 132, 142 and the supporting bolts 152 rest on the bearing elements 122 and 123 respectively, and thus form a centering three-point rest for each tong module. The tongs of the tong module 12*c* are located in their closed position and have seized a workpiece W3, whereas the tongs of the tong module 12*b* are located in their open position and have not yet seized a workpiece W2.

As is described in detail below, the opening and closing movements of the tongs are controlled by the control shaft 3, which is driven by a control-shaft drive device 30 arranged outside the forming region of the forming machine. The transverse transporting tube 2 is moved back and forth by means of a transverse-transportation drive device 4, and a transverse-transporting-tube-rotating device 5 rotates the transverse transporting tube 2 for the purpose of raising and lowering the tong casing 1. The transverse-transportation drive device 4 and the transverse-transporting-tube rotating device 5 are likewise arranged outside the forming region of the forming machine and are described in more detail below.

The operating sequence is generally as follows:

The tongs seize their respectively associated workpieces, are transported, by virtue of transverse displacement of the transverse transporting tube 2, from one forming station U1, U2, U3 to the respectively adjacent forming station U2, U3, U4 and release the workpieces there for the forming process. The tong casing 1 with the tongs is then raised, by virtue of rotation of the transverse transporting tube 2, the transverse transporting tube 2 is displaced back again with the tong casing 1, and the tong casing 1 is lowered again into the starting position.

The following statement holds for the rest of the description in its entirety. If, for clarity of the illustration, designations are contained in a figure but are not explained in the relevant text of the description, or vice versa, then please refer to the point at which they were mentioned in preceding figure descriptions.

FIG. 2

The three sets of tongs of the tong modules 12*a*, 12*b*, 12*c* are each illustrated in their closed position, in which they have seized three workpieces W1, W2, W3, and their open position. Each set of tongs comprises two tong arms 13, 14 which are designed as double-armed levers, are fitted rotatably on pivot articulations 132, 142 and of which one end is formed by tong grippers 130, 140 provided with tong shoes 131, 141. The tong grippers 130, 140 are connected to the rest of the tong arm 13, 14 via predetermined breaking points 133, 143, with the result that in the event of malfunctioning during the forming operation, it is generally only the tong grippers 130, 140 which break off, and the rest of the apparatus remains intact. The predetermined breaking points 133, 143 are preferably monitored by sensors 134, 144.

The pivot articulations 132, 142 of each set of tongs are arranged, or the lengths of the two levers of each tong arm 13, 14 are selected, such that the tongs have a tong displacement which is suitable for the workpiece W1, W2, W3 which is to be seized. The tong modules 12*a*, 12*b*, 12*c* are illustrated here with tongs which are suitable for workpieces of small, medium and large diameters, respectively. In a change in production, the transporting apparatus of the forming machine can easily be converted for new workpieces by exchanging tong modules.

The operations of opening and closing the tongs take place by rotation of the tong arms 13, 14 around the pivot articulations 132, 142. For this purpose, one end of the tong arm 14 is coupled, at a coupling location 19, to transmission means, which are arranged in the tong-casing basic body 10 and convert the rotation of the control shaft 3 into a suitable rotary back-and-forth movement. The tong arm 13 is simultaneously rotated by the tong arm 14 via operatively connected guide surfaces 135, 145 which are arranged on the two tong arms 13, 14. A spring 136 ensures that the guide surface 135 is constantly forced against the guide surface 145 and the tongs are prestressed such that they have the tendency to close.

Figure 2:
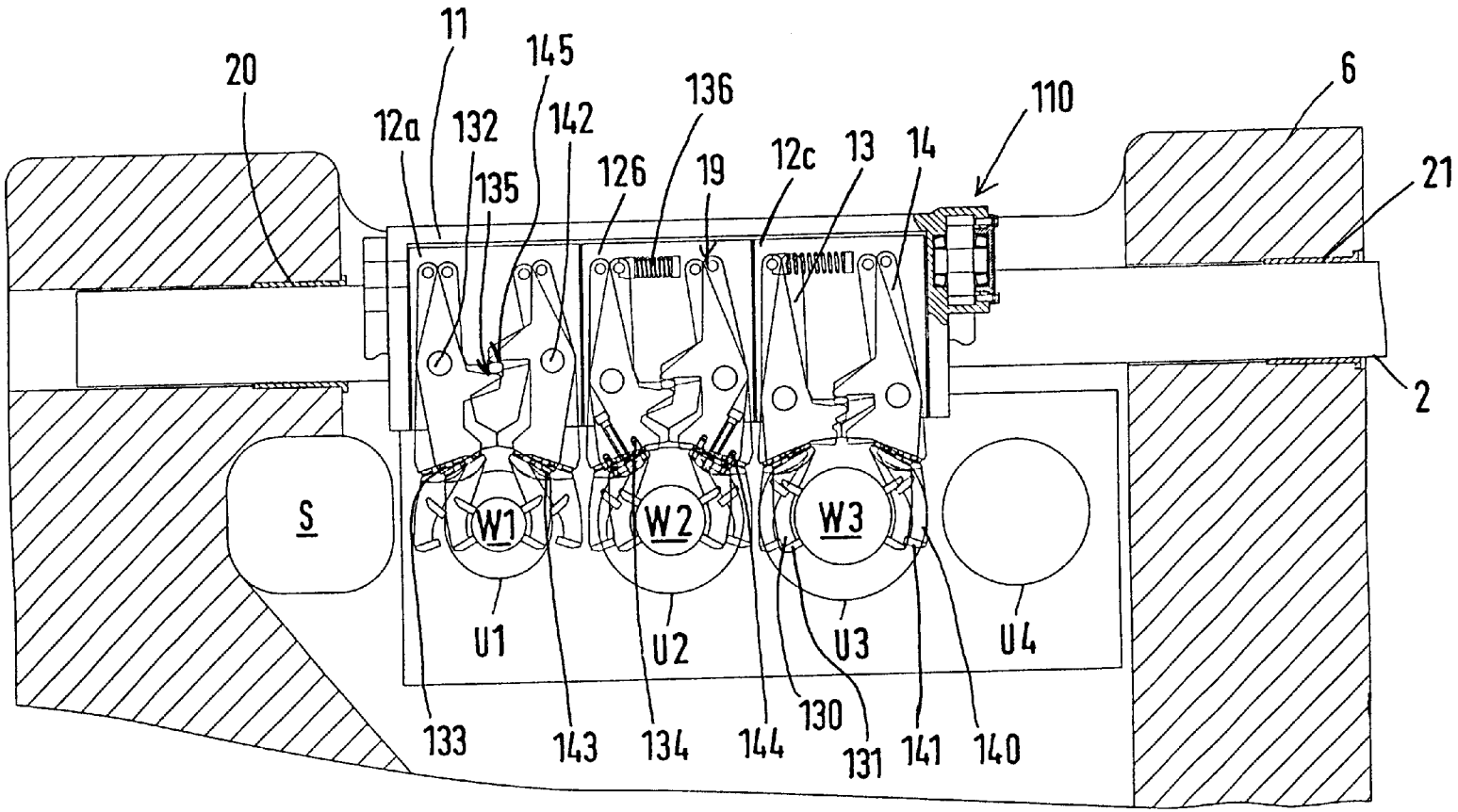
FIG. 2 shows part of the apparatus of FIG. 1 in the forming region of the forming machine, three sets of tongs with different displacements being illustrated.
Figure 3:
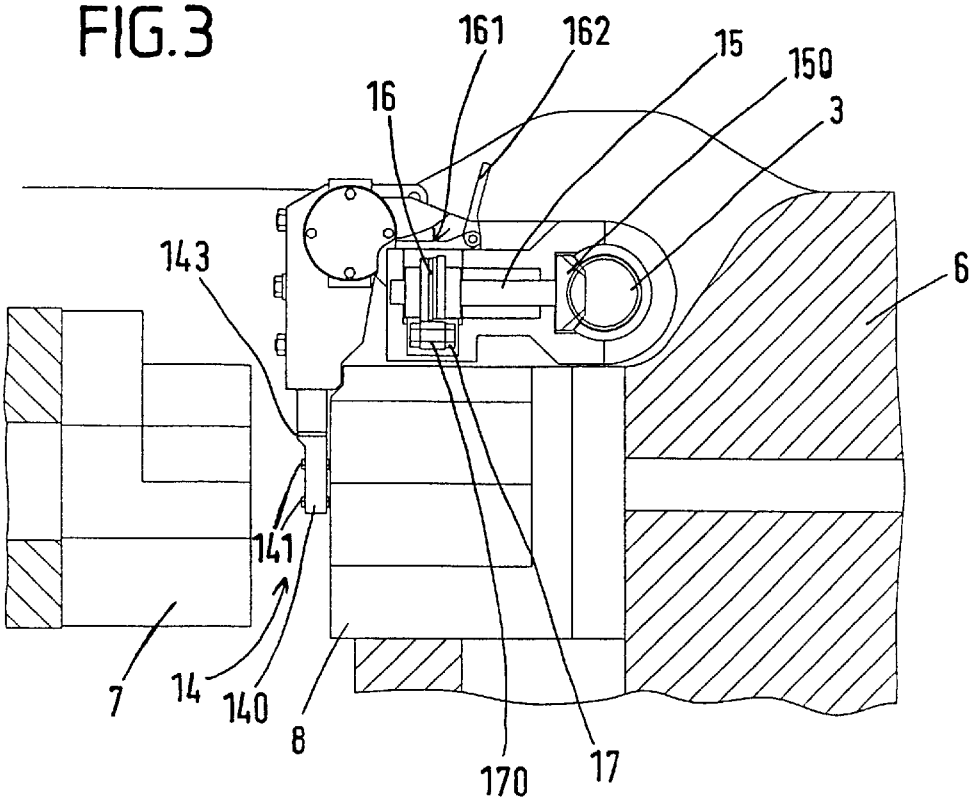
FIGS. 3, 4 show cross-sections through part of the apparatus of FIG. 1 in the forming region of the forming machine in order to illustrate the opening and closing movements of the tongs.
Figure 4:
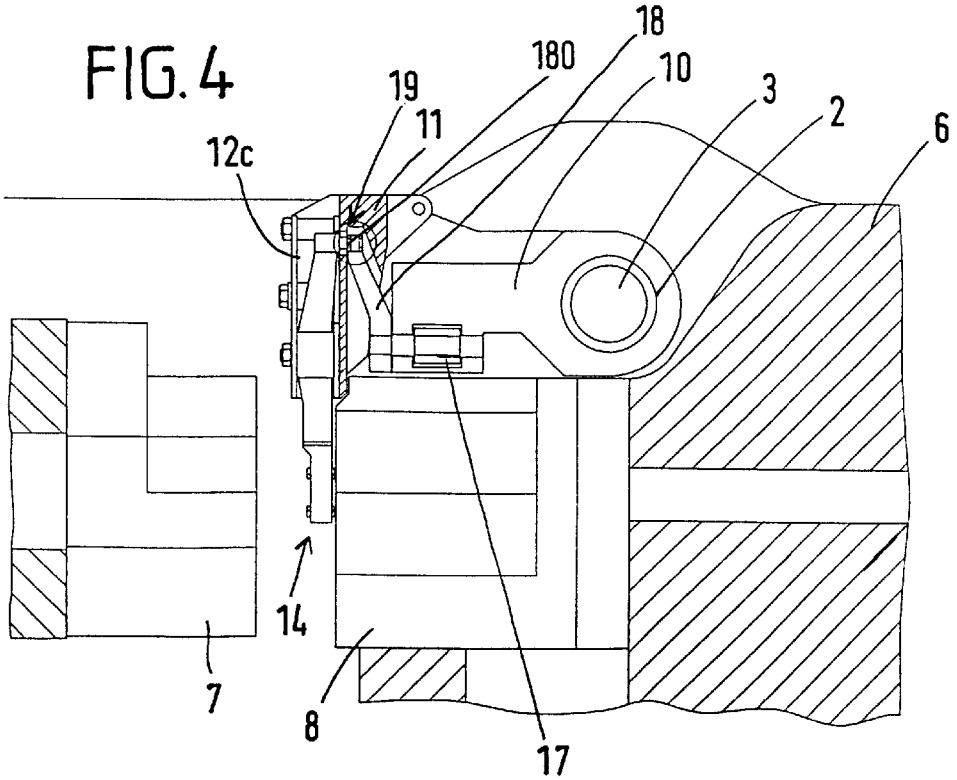

It can also be seen in FIG. 2 that the module carrier 11 is fitted on the tong-casing basic body 10 such that it can be pivoted by preferably prestressed rolling-contact bearings 110. The purpose of this arrangement will be explained below in conjunction with FIGS. 8 and 9.

FIGS. 3 to 6

Arranged in the forming region of the forming machine, opposite the anvil 8, is a die holder 7 for receiving forming dies, the workpiece-transporting tongs passing into the space between the die holder 7 and anvil 8.

Provided, for the purpose of opening and closing the tongs, between the control shaft 3 and the tong arm 14, are transmission means, which comprise a tong drive shaft 15 with a tong cam 16, as well as a roller lever 17 and a tong drive lever 18. The generally uniform rotation of the control shaft 3 is transmitted, via a bevel gear mechanism 150, to the tong drive shaft 15, on which the tong cam 16 is fitted. A roller 170 which is arranged rotatably at a first end of a roller lever 17 rests against the tong cam 16 (see FIGS. 3 and 6), while the second end of the roller lever 17 is connected fixedly to a first end of the tong drive lever 18 (see FIGS. 4 to 6). The second end of the tong drive lever 18 is connected rotatably to the tong arm 14 via a coupling device 180 (see FIGS. 4 and 6).

Figure 6:
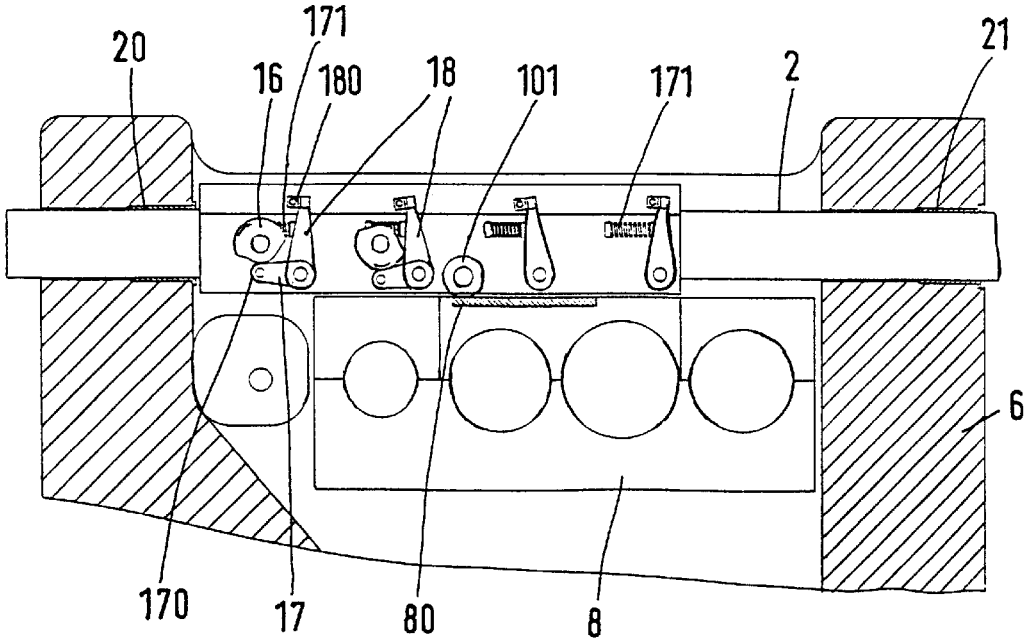
FIG. 6 shows part of the apparatus of FIG. 1 in the forming region of the forming machine, although, unlike FIG. 1, four tong drives are depicted in order to illustrate the opening and closing movements and the precise positioning of the tongs.

In FIG. 6 the first tong drive lever 18 from the left is illustrated in a position in which the associated tongs are closed, while the second tong drive lever 18 from the left is illustrated in a position in which the associated tongs are open. During opening of the tongs, the tong cam 16, which rotates on account of the rotation of the tong drive shaft 15, forces the first end of the roller lever 17, said first end bearing the roller 170, downwards, as a result of which the tong drive lever 18 is rotated to the left.

During closure of the tongs, a spring 171 which acts on the tong-casing basic body forces the tong drive lever 18 to the right, as a result of which the first end of the roller lever 17 is moved upwards, with the result that the roller 170 always rests against the tong cam 16.

The tong cam 16 can be adjusted through an adjustment opening 161 (see FIG. 3), which is provided in the tong-casing basic body and can be closed by a cover 162, with the result that different sequences of opening and closing movements and different tong displacements can be easily set.

Figure 5:
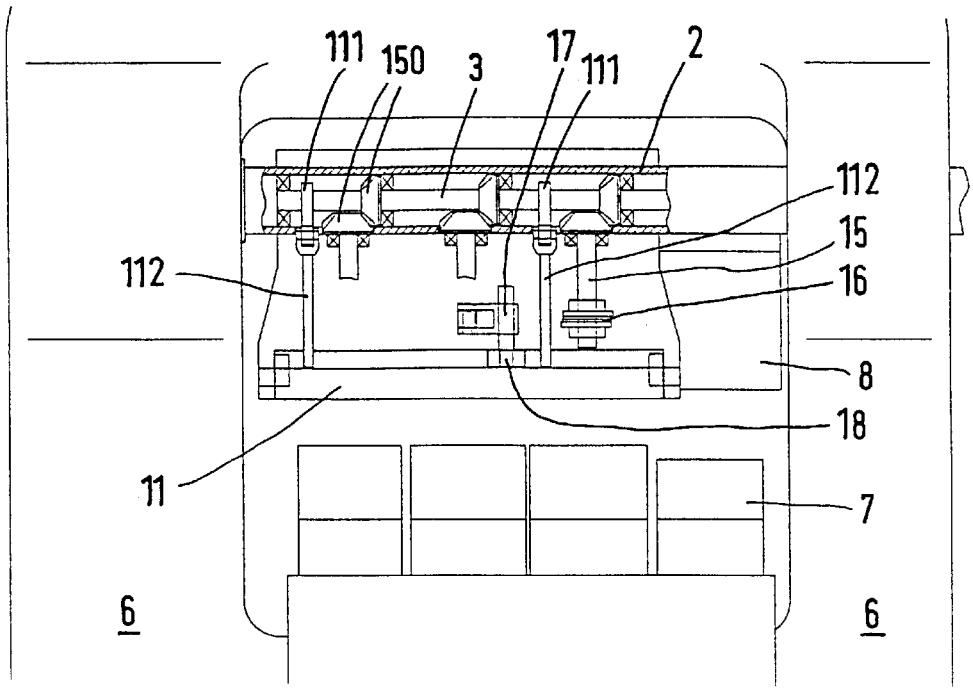
FIG. 5 shows a plan view of part of the apparatus of FIG. 1 in the forming region of the forming machine in order to illustrate the opening and closing movements of the tongs.

In FIG. 5, it is possible to see two push rods 112, which are arranged between the module carrier 11 and pivoting cams 111, fitted on the control shaft 3, and which serve for pivoting the module carrier 11 relative to the tong-casing basic body 10, this being described in more detail in conjunction with FIGS. 8 and 9.

FIG. 6 also illustrates a rule 80 which is arranged on the anvil 8 and serves for precise vertical positioning of the tongs in the forming stations U1, U2, U3, U4. For this purpose the tong casing 1 is provided with a roller 101 by means of which it is supported on the rule 80. In this way, the vertical positioning accuracy of the tongs in the forming stations U1, U2, U3, U4 is independent of the accuracy of the operations for lowering and displacing the tong casing 1 in the transporting direction. Two variants for fitting the roller 101 on the tong casing 1 will be explained in conjunction with FIGS. 10 and 11.

FIG. 7

At its end which is directed towards the coupling device 180, the tong arm 14 has a coupling pin 146 on which a first cubic part 182 is mounted rotatably. The coupling device 180 also comprises a second cubic part 181, which is mounted rotatably on a second coupling pin 185, which is approximately at right angles to the first coupling pin and is fitted on the tong drive lever 18. The two cubic parts can be rotated and displaced with respect to one another via sliding surfaces 183, 183'. This allows transmission of the movement of the tong drive lever 18 to the tong arm 14 even during pivoting of the module carrier 11—with the tong arm 14—relative to the tong-casing basic body 10—with the tong drive lever 18.

Different lever lengths of the tong arm 14 (illustrated by dashes) can be obtained by changing the tong modules, and the cubic parts 181, 182 can be rotated and, in some circumstances, coupled again via two different sliding surfaces.

At its end which is opposite the coupling device 180, the tong drive lever 18 is provided with an extension 184 which extends at right angles away from the basic body of the lever and is intended for the roller lever 17.

FIGS. 8 and 9

In order to prevent the tongs from striking against the die holder 7, or a die fitted thereon, when the tong casing 1 is being raised, the bottom part of the tong-bearing module carrier 11, said bottom part being directed towards the anvil 8, is simultaneously pivoted towards the anvil 8 around a module-carrier pivot spindle 113. The pivoting is controlled by the pivoting cam 111 which is fitted on the control shaft 3, a pivoting spring 114 exerting a force which presses the bottom module-carrier part against one end of the push rod 112, of which the other end rests against the pivoting cam 111. In order to avoid non-symmetrical loading, it is advantageous for two pivoting springs 114, two push rods 112 and two pivoting cams 111 to be provided (see FIG. 5).

In FIG. 8, the tong casing 1 is also illustrated in a position in which it has been raised away from the anvil 8 to the full extent, the tong casing 1 being moved into this position for the purpose of changing dies or carrying out maintenance work in the die space.

Figure 10:
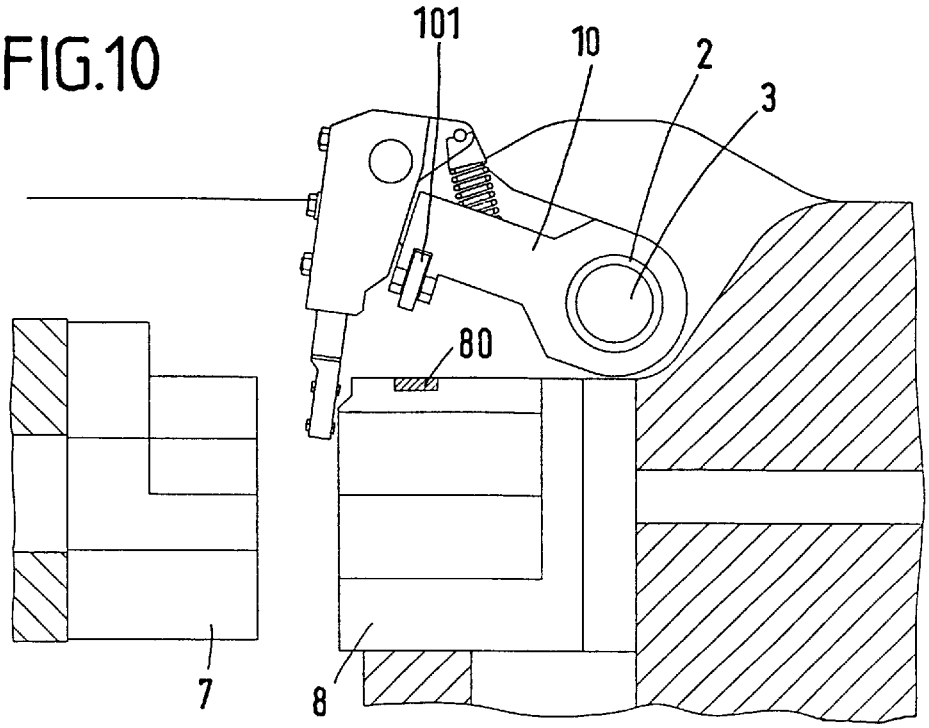
FIGS. 10,11 show two variants of rolling-action guide means for the precise positioning of the tongs.
Figure 11:
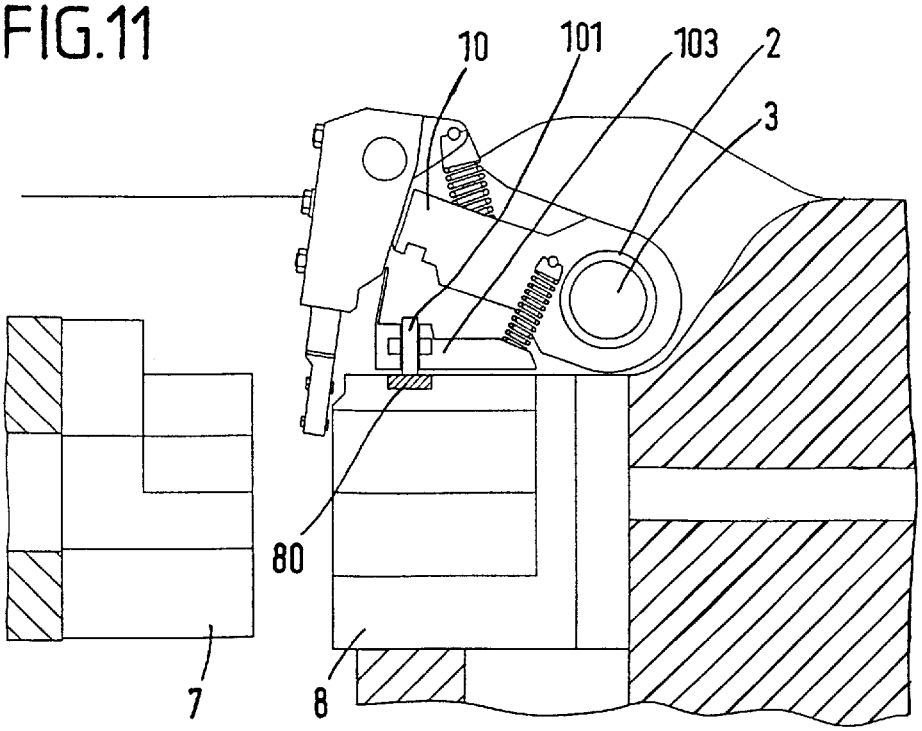

FIGS. 10 and 11

For precise vertical positioning of the tongs in the forming stations U1, U2, U3, U4, in the variant illustrated in FIG. 10, the tong casing 1 is supported on the rule 80 fitted on the anvil 8, via a roller 101 which is fitted rotatably on the tong-casing basic body 10. In the variant illustrated in FIG. 11, the roller 101 is fitted on a positioning part 103 which can be pivoted with respect to the tong-casing basic body 10 and, even when the tong casing 1 is in the raised state, ensures contact of the roller 101 with the rule 80.

Figure 10A:
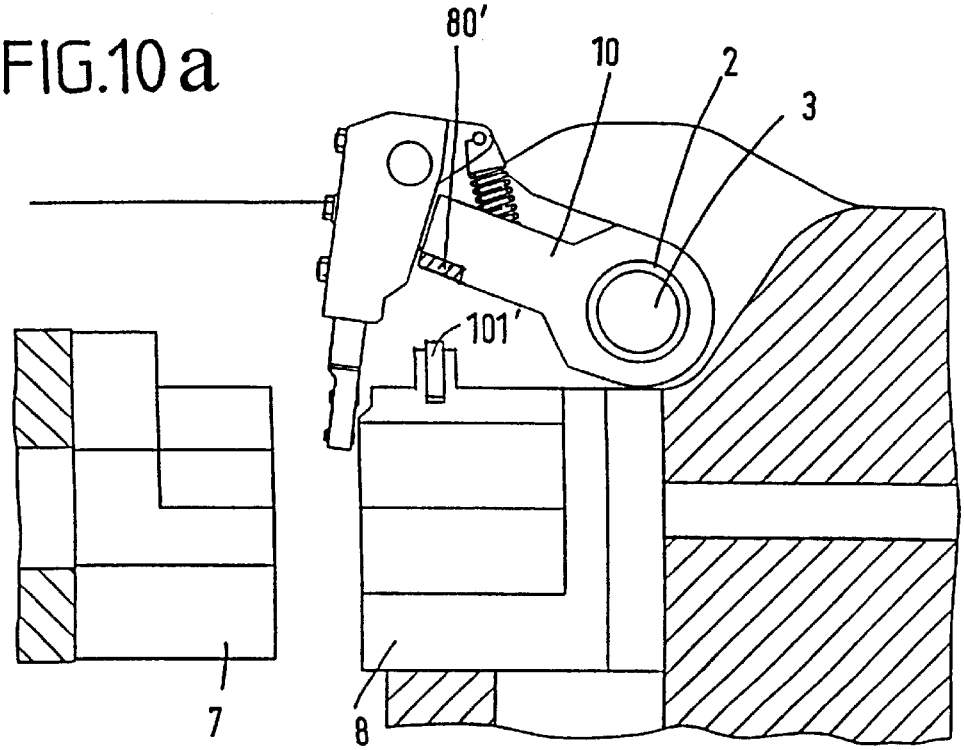
FIGS. 10*a,* 11*a* shows the two variants of rolling action guide means similar to those shown in FIGS. 10 and 11, but having the rule and roller subcomponents in different locations.
Figure 11A:
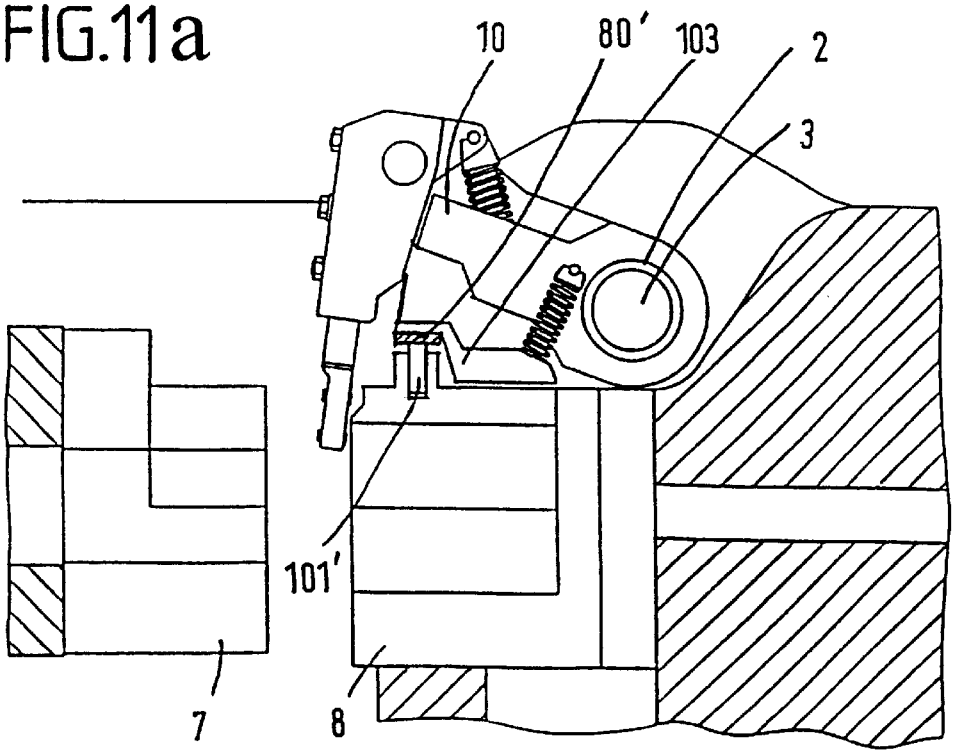

FIGS. 10*a* and 11*a*

The variants shown in FIGS. 10*a* and 11*a* are similar to those shown in the previous FIGS. 10 and 11, except for the positions of the rule 80' and the roller 101'. In the variant shown in FIG. 10*a*, the roller 101' is rotatably fitted onto the anvil 8 and the rule 80' is fitted onto the tong-casing basic body 10. In FIG. 11*1*, the roller 101' is still rotatably fitted onto the anvil 8, but the rule 80' is fitted onto the positioning part 103 so that, even when the tong casing 1 is in the raised state, the roller 101' remains in contact with the rule 80'.

Figure 12:
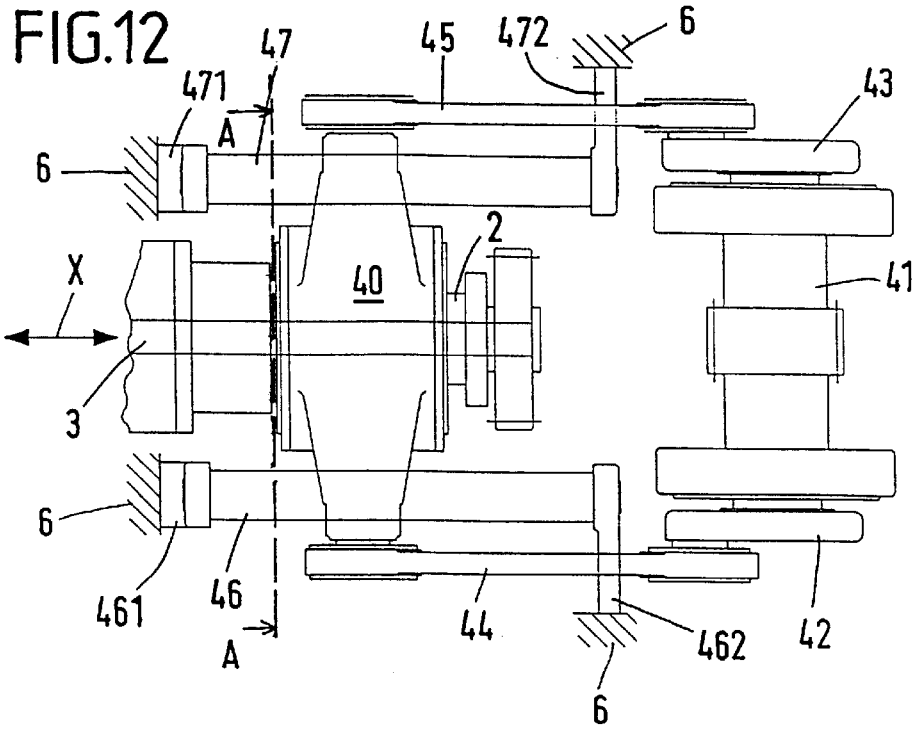
FIG. 12 shows a plan view of a transverse-transportation drive device.
Figure 13:
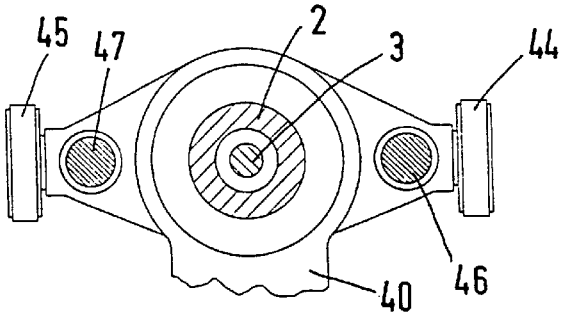
FIG. 13 shows a cross-section through the transverse-transportation drive device along line A—A in FIG. 12.
Figure 14:
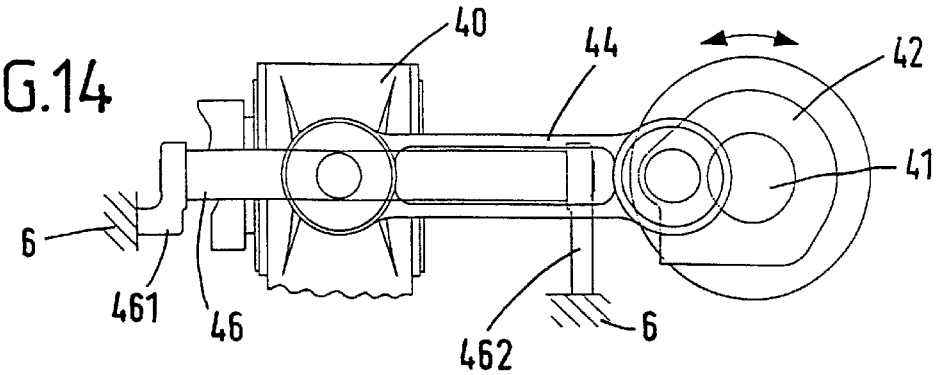
FIG. 14 shows a front view of the transverse-transportation drive device of FIG. 12.
Figure 16:
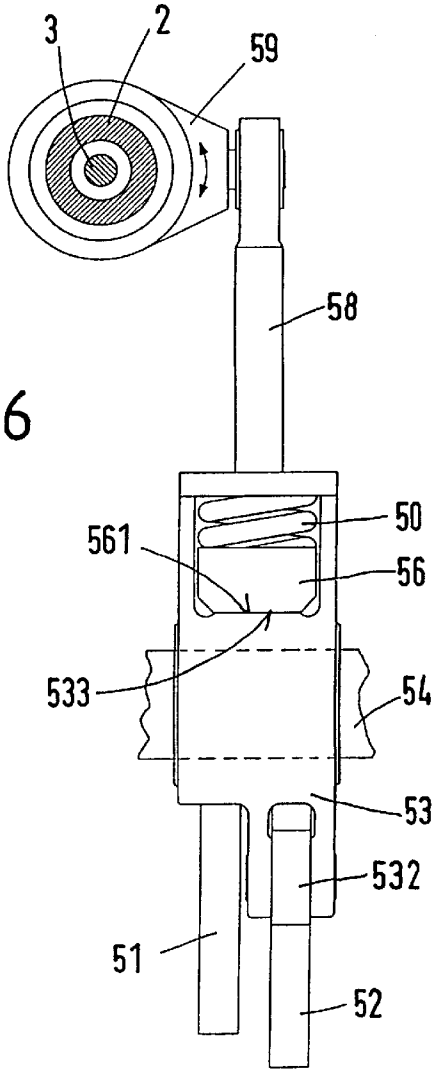
FIG. 16 shows a side view of the transverse-transporting-tube-rotating device of FIG. 15.

FIGS. 12 to 14

The transverse-transportation drive device 4 for the back-and-forth movement of the transverse transporting tube 2 in the direction of the arrows X comprises a drive shaft 41 which is at right angles to the transverse transporting tube 2 and, via two cranks 42, 43 and two connecting rods 44, 45, moves back and forth a crosshead 40 which is borne by two guide rods 46, 47, parallel to the transverse transporting tube 2. The guide rods 46, 47 are fitted on the machine body 6 by means of fastening elements 461, 462, 471, 472.

One end of the transverse transporting tube 2 is mounted in the crosshead 40 such that it is connected to the latter in a rotatable and axially prestressed manner. This allows, on the one hand, raising and lowering of the tong casing 1 by virtue of rotation of the transverse transporting tube 2 and, on the other hand, movement of the tong casing 1 back and forth by virtue of transverse displacement of the transverse transporting tube 2.

FIGS. 15 to 18

The control shaft 3 is driven here by a control-shaft drive device 30, which has a drive shaft 31 arranged parallel to the control shaft 3. The rotation of the drive shaft 31 is transmitted to the control shaft 3 via a wheel mechanism 32.

Figure 15:
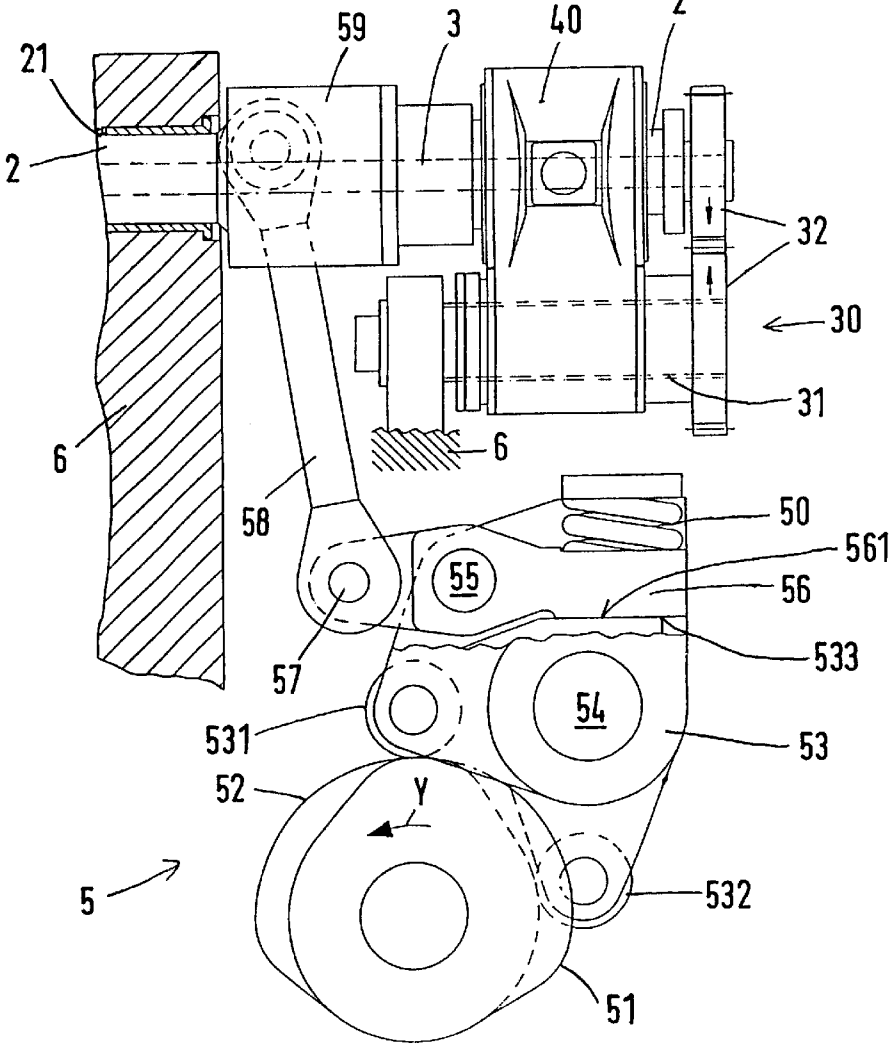
FIGS. 15,17,18 show front views of a transverse-transporting-tube-rotating device, of a control-shaft drive device and of part of the transverse-transportation drive device of FIG. 12

The transverse-transporting-tube-rotating device 5 for rotating the transverse transporting tube 2 comprises two control cams 51, 52 against which there rests in each case one roller 531, 532 of a drive lever 53 which can be rotated around a spindle 54. A compensating lever 56 is articulated on the drive lever 53 via an articulation pin 55. The compensating lever 56 has a contact surface 561 which, in the starting position which is illustrated in FIG. 15, is forced, by means of a compensating spring 50, against a contact surface 533 provided on the drive lever 53. The compensating lever 56 is articulated at the bottom end of a connecting rod 58 via a further articulation pin 57. The top end of the connecting rod 58 is connected to a sleeve-like transmission lever 59 which is arranged around the transverse transporting tube 2 and transmits connecting-rod movements to the transverse transporting tube 2. This can be achieved, for example, by means of a fluid-cylinder-controllable press connection between the transverse transporting tube 2 and transmission lever 59, in order, by releasing the press connection, to be able to move the tong casing 1 into the position in which it has been raised to the full extent, illustrated in FIG. 8.

Figure 17:
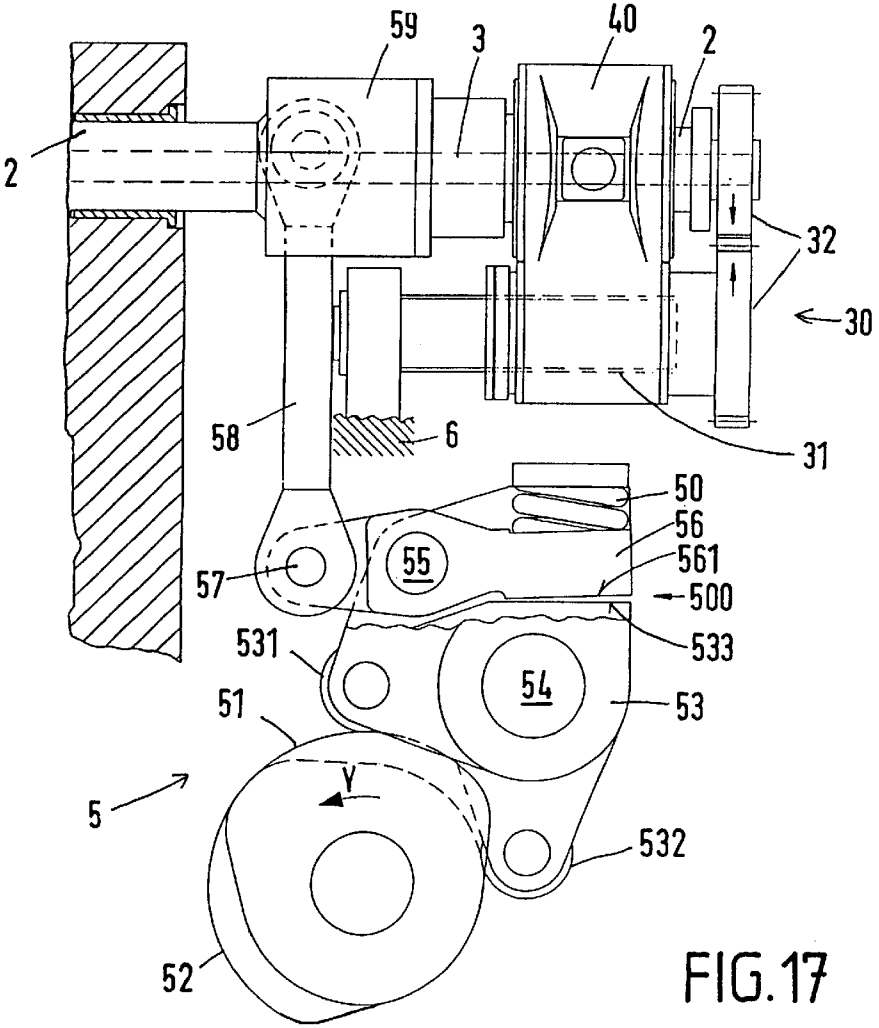

In the starting position which is illustrated in FIG. 15, the tong casing 1 is located in the lowered position and the tongs are assigned to the first three forming stations U1, U2, U3. In the event of the tongs being moved to the adjacent forming stations U2, U3, U4, i.e. in the event of the transverse transporting tube 2 being displaced transversely to the right, then, as can be seen in FIG. 17, the top end of the connecting rod 58 is displaced to the right. In this first movement phase, until the connecting rod 58 has reached the vertical position, the articulation pin 57, along with that end of the compensating lever 56 which is assigned to it, is forced downwards and the contact surface 561 is forced upwards. Since, during simultaneous rotation of the control cams 51, 52 in the direction of the arrow Y, the drive lever 53 does not initially change its position, a gap 500 opens between the two contact surfaces 533 and 561. In a second phase of the transverse transporting tube 2 moving to the right, the gap 500 is closed again since the articulation pin 57, along with that end of the compensating lever 56 which is assigned to it, is drawn upwards again and the contact surface 561 is thus forced downwards.

In this way, it is possible for the positioning of the connecting rod 58 in the upright position, this taking place by virtue of displacement of the transverse transporting tube 2 and thus of the top end of the connecting rod 58, to be counteracted, with the result that undesired rotation of the transverse transporting tube 2 is prevented.

Figure 18:
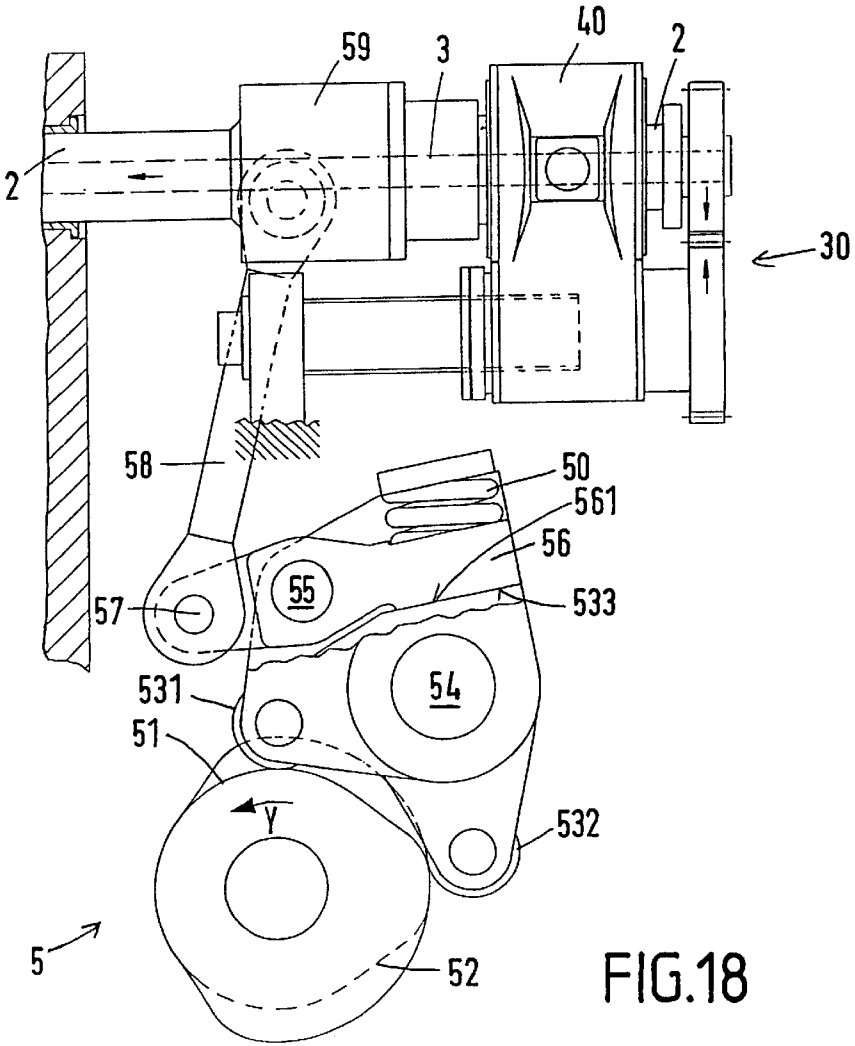

In the position illustrated in FIG. 18, the tong casing 1 is located at the end of the transverse displacement to the right and, in this position, the workpieces W1, W2, W3 have already been received by the forming stations U2, U3, U4 and released by the tong grippers. By virtue of the control cams 51, 52 continuing to rotate, the drive lever 53 has been rotated in the counter-clockwise direction and the contact surface 561 of the compensating lever 56 has been forced upwards, and the articulation pin 57 has thus been forced downwards. As a result, the connection rod 58 has been drawn downwards, which, via the transmission lever 59, has caused the transverse transporting tube 2 to rotate and the tong casing 1 to be raised. In the position illustrated, the tong casing 1 is ready to be displaced back.

For displacing the tong casing 1 back, and lowering the same, the movement sequence takes place in reverse order, although no gap is produced.

Further design variations can be realized in relation to the above described transporting apparatus. We would like to make express mention here of the fact that, as an alternative to the variants illustrated in FIGS. 10 and 11 for precise vertical positioning of the tongs, it is, of course, also possible for a sliding-action guide means to be used instead of a rolling-action guide means.

Instead of the rotational speed of the control shaft 3 being kept constant, it is also possible for it to be varied appropriately, during the raising and lowering of the tong casing 1, in order to compensate for the speed of the opening and closing movements of the tongs which is changed, during the raising and lowering of the tong casing 1, by bevel gears which belong to the bevel gear mechanism 150 and are arranged on the tong drive shafts 15 rolling on the bevel gears arranged on the control shaft 3.

What is claimed is:

1. An apparatus for automatically transporting workpieces from station to station in a multi-stage forming machine having a plurality of forming stations, comprising:

a transporting tube mounted above the forming stations for reciprocating movement therealong;

a control shaft rotatably mounted inside said transporting tube;

a tong casing attached to said transporting tube, said tong casing including a body and at least one exchangeable tong module positioned on said body, each tong module having an associated set of tongs moveable between a closed position for gripping a workpiece laterally and from above and an open position for releasing a workpiece laterally and from above; and at least one transmission means for transmitting motion from said control shaft to said tongs, each transmission means being connected via a coupling location, to a corresponding set of said tongs and including a tong cam for controlling the movement of said corresponding set of said tongs between its said open and closed positions, the stroke of said tongs being adapted to the workpieces.

2. An apparatus according to claim 1, wherein each set of said tongs includes a first tong arm pivotally mounted about a first pivot axis in a corresponding tong module and a second tong arm pivotally mounted about a second pivot axis in said corresponding tong module, said first and said second tong arms each having a double-armed lever with a gripper member, said first and said second tong arms being connected to each other by guide surfaces, said first tong arm being pivotable by its corresponding transmission means such that as said first tong arm is pivoted to its closed position, said second tong arm is simultaneously pivoted to its closed position by said guide surfaces.

3. Apparatus according to claim 1, wherein each of said at least one transmission means includes a tong drive shaft having a first end connected to said control shaft by a bevel gear mechanism and a second end connected to a corresponding tong cam; and a lever connected between said corresponding tong cam and said corresponding set of said tongs such that motion of said tong drive shaft is transferred to said corresponding set of said tongs, thereby controlling the opening and closing movement of said corresponding set of said tongs.

4. Apparatus according to claim 1, further comprising rotating means connected to said transporting tube for rotating said transporting tube to thereby raise and lower said tong casing.

5. Apparatus according to claim 4, wherein each tong module is seated in a module carrier connected to said body of said tong casing by a pivot spindle, such that, when said tong casing is raised, said module carrier is independently pivotable in an opposite direction.

6. Apparatus according to claim 5, further comprising at least one pivoting cam positioned on said control shaft; and at least one push rod, each push rod being connected to a corresponding pivoting cam and to said module carrier, thereby controlling the pivoting of said module carrier relative to said body of said tong casing.

7. Apparatus according to claim 5, wherein each of said coupling locations is positioned adjacent to said pivot spindle.

8. Apparatus according to claim 5, wherein the forming machine includes an anvil, said tong casing being supported in its lowered position on said anvil by positioning means for positioning said tong casing in a vertical orientation.

9. Apparatus according to claim 8, wherein said positioning means includes a rule located on said anvil and at least one roller located on said tong casing.

10. Apparatus according to claim 9, wherein said at least one roller is located on said body of said tong casing.

11. Apparatus according to claim 9, wherein said at least one roller is mounted oh a positioning part which is pivotally attached to said body of said tong casing, such that, when said tong casing is in its raised position, said at least one roller maintains contact with said rule.

12. Apparatus according to claim 8, wherein said positioning means includes a rule located on said tong casing and at least one roller located on the anvil.

13. Apparatus according to claim 12, wherein said rule is located on said body of said tong casing.

14. Apparatus according to claim 12, wherein said rule is mounted on a positioning part which is pivotally attached to said body of said tong casing, such that, when said tong casing is in its raised position, said rule maintains contact with said at least one roller.

15. An apparatus according to claim 1, wherein each transmission means is connected to a corresponding set of tongs by an associated coupling device which includes two cubic parts, each cubic part being rotatably positioned on a corresponding coupling pin and having a sliding surface, said cubic parts being connected to each other by their said sliding surfaces.

16. Apparatus according to claim 1, further comprising a crosshead supported by two guide rods positioned parallel to said transporting tube, said crosshead being movable along said guide rods, one end of said transporting tube being mounted in said, crosshead, such that said transporting tube is movable in conjunction with said crosshead.

17. Apparatus according to claim 16, wherein said crosshead is moved by a drive device including at least one crank and at least one connecting rod, each connecting rod being connected to a corresponding one of said at least one cranks and being mounted between its said corresponding crank and said crosshead.

18. Apparatus according to claim 1, wherein the forming machine is a hot-forming machine.

19. Apparatus according to claim 2, wherein said open and closed positions of said corresponding set of said tongs are adjustable by replacing said corresponding tong module with another corresponding tong module having said first and second pivot axes in different predetermined locations.

20. Apparatus according to claim 1, wherein said open and closed positions of said corresponding set of said tongs are adjustable by replacing at least one of said tong cams with a different tong cam having a different configuration such that said movement of said corresponding set of said tongs is controlled in a different manner.

21. Apparatus according to claim 1, wherein each of said tong cams has varying means for varying said open and closed positions of said corresponding set of said tongs.

22. Apparatus according to claim 1, wherein the stroke of the tongs is adaptable to the workpieces by replacing at least one of said tong modules with a different tong module having a different configuration such that said different tong module has a different leverage.

* * * * *